US010054380B1

(12) United States Patent
Walters

(10) Patent No.: US 10,054,380 B1
(45) Date of Patent: Aug. 21, 2018

(54) HANDGUN LOADING ASSISTANT DEVICE

(71) Applicant: Donald A Walters, Centerville, TX (US)

(72) Inventor: Donald A Walters, Centerville, TX (US)

( * ) Notice: Subject to any disclaimer, the term of this patent is extended or adjusted under 35 U.S.C. 154(b) by 0 days.

(21) Appl. No.: 15/916,568

(22) Filed: Mar. 9, 2018

Related U.S. Application Data

(60) Provisional application No. 62/482,767, filed on Apr. 7, 2017.

(51) Int. Cl.
*F41A 9/83* (2006.01)

(52) U.S. Cl.
CPC ..... *F41A 9/83* (2013.01)

(58) Field of Classification Search
CPC .. F41C 9/085; F41C 27/00; F41C 7/00; F41A 9/00; F41A 9/38; F41A 9/83; F41A 3/72
See application file for complete search history.

(56) References Cited

U.S. PATENT DOCUMENTS 4,043,065 A * 8/1977 Musgrave ..... F41A 19/34 224/911
7,543,404 B2 * 6/2009 Kovalchuk ..... F41C 33/0263 224/192
9,121,662 B1 * 9/2015 Love ..... F41C 27/00
9,157,691 B2 * 10/2015 Parnell ..... F41A 3/72
9,194,636 B2 * 11/2015 McAninch ..... F41A 7/00
9,194,654 B1 * 11/2015 Viani ..... F41A 3/72
D757,882 S * 5/2016 Biedenbach ..... D22/108
9,423,209 B1 * 8/2016 Hoeffken ..... F41A 35/00
9,500,439 B1 * 11/2016 Dietrich ..... F41A 3/72
9,546,843 B2 * 1/2017 Sroufe ..... F41C 3/00
9,587,905 B1 * 3/2017 Biedenbach ..... F41C 23/10
9,733,043 B1 * 8/2017 Cohen ..... F41C 27/00
9,995,544 B1 * 6/2018 Akimov ..... F41A 3/72
2011/0010978 A1 * 1/2011 Hooks ..... F41A 17/46 42/69.01
2011/0154710 A1 * 6/2011 Hatfield ..... F41A 19/34 42/90
2012/0198744 A1 * 8/2012 Meller ..... F41A 3/72 42/90
2013/0081318 A1 * 4/2013 Morando ..... F41A 35/00 42/108
2013/0111799 A1 * 5/2013 Lee ..... F41C 27/00 42/106
2013/0180152 A1 * 7/2013 Speroni ..... F41C 27/00 42/99
2013/0255478 A1 * 10/2013 McAninch ..... F41A 7/00 89/1.4
2014/0047753 A1 * 2/2014 Grossman ..... F41A 3/66 42/72
2014/0298703 A1 * 10/2014 Gale ..... F41C 27/00 42/71.02

(Continued)

*Primary Examiner* — Benjamin P Lee
(74) *Attorney, Agent, or Firm* — Frank H. Pham; Pham IP Group

(57) ABSTRACT

A firearm weapon loading system includes a handgun loading and cocking assistant device having a slidable alignment guide and a body holder. The slidable alignment guide is coupled with the body holder, and the handgun selectively engages the device when the magazine is ready to load into the handgun. The device is selectively positioned on the handgun to facilitate loading and cocking the handgun with one hand.

4 Claims, 3 Drawing Sheets

(56) References Cited

U.S. PATENT DOCUMENTS

| | | | | |
|---|---|---|---|---|
| 2015/0184959 | A1* | 7/2015 | Parnell | F41A 7/00<br>89/1.4 |
| 2015/0300776 | A1* | 10/2015 | Lee | F41A 9/38<br>42/90 |
| 2015/0345897 | A1* | 12/2015 | Koenig | F41C 27/00<br>42/90 |
| 2015/0354909 | A1* | 12/2015 | Tarantino | F41A 3/72<br>89/1.4 |
| 2016/0061562 | A1* | 3/2016 | Braun | F41A 3/72<br>42/111 |
| 2016/0102938 | A1* | 4/2016 | Sroufe | F41A 3/72<br>42/16 |

* cited by examiner

HANDGUN LOADING ASSISTANT DEVICE

CROSS-REFERENCE TO RELATED APPLICATION

The present application is based on, and claims the benefit of priority of U.S. application Ser. No. 62/482,767 filed on Apr. 7, 2017, the disclosure of which is hereby incorporated by reference herein in its entirety.

BACKGROUND OF THE DISCLOSURE

The disclosure relates to a handgun loading and cocking assistant device and more particularly pertains to a novel device for loading and cocking a semi-automatic handgun with one hand.

Loading (also referred to as hand loading) is the process of loading firearm ammunition. This is done by individuals with capacity to apply force for loading the ammunition. In addition, cocking a semi-auto handgun is the process of racking the slide of the gun that requires hand strength. The bolt of the gun has to be cocked to a rear position in order to begin the cycle of ammunition round firing. The cocking of the bolt brings it to an engaged position by urging it against a spring. The bolt or bolt assembly is released from its rear position to insert a cartridge in the firing chamber of the gun and then to remove the unfired cartridge or the empty case after the round is fired. The bolt fits in the gun behind the firing chamber.

Many people lose grip strength due to illness or injury. They have lost hand strength and have trouble racking the slide on a semi-automatic handgun because they cannot grip the slide as firmly as they once did. These people, in particularly, have often been advised away from the semi-auto handgun because it is unsafe to use the gun when they are unable to rack it.

It would be desirable to provide a commercial product that comprises material suitable for device assists individuals who lack capacity of gripping fingers or hand to pull the slide of a semi-automatic handgun rearward for loading and/or cocking operation that is typically associated with small size firearm such as semi-automatic pistol. It is further desirable for a handgun cocking assistant device for disabled people with a safe alternative, which approximates the size, density and weight of lead. It also would be desirable to provide a commercial product that comprises material suitable for shaping and making the device.

SUMMARY OF THE DISCLOSURE

An embodiment of the disclosure meets the needs presents a weapon loading system includes a handgun cocking assistant device having a slidable alignment guide and a body holder. The slidable alignment guide is coupled with the body holder, and the handgun selectively engages the device when the magazine is ready to load into the handgun. The device is selectively positioned on the handgun to facilitate loading the magazine into the handgun with one hand.

The present invention utilizes existing objects in a new and nonobvious way. It relates to a semi-automatic handgun or pistol loading and/or cocking assistant device that has a slidable alignment guide and a block body holder. The pistol selectively engages the device when the magazine is loaded into the pistol. The slidable alignment guide engages the slide such that the coil spring is compressed when the pistol engages the block body holder. Thus, the pistol may be loaded and/or cocked with one hand.

In a preferred embodiment of the invention, the device comprises a block body holder which contains internal parts necessary for the operation of the device. When the device is in a position for the operation, the face of the block body forces pistol slide to rear most position. A user applies pressure on the block body holder and the pistol in opposite direction to cause the pistol slide to move rearward, while the pistol barrel is allowed to move into the loader cavity. When the rearward motion of the pistol slide is reached, a cartridge is pushed upward into the chamber by the magazine spring.

Another preferred embodiment of the invention, the slidable alignment guide is a small diameter end of the guide alignment assembly with pistol barrel. When the assembly and pistol are pressed together, the guide is pushed rearward in the body cavity, allowing the pistol barrel to enter the body cavity and space for spring as it is compressed.

In a preferred embodiment of the invention, the device further comprises a longitude channel having first end and second end that allows the slidable alignment guide to reciprocally slide between retracted position and extended position. Further, the slidable alignment guide comprises a manipulation protruding through the second end of the channel when it is extended position.

In another preferred embodiment of the invention, the device includes a spring stop at one end of the block body holder for retaining a coil spring in between the rear of the device and slidable alignment guide. The coil spring positions the slidable alignment guide in place at front of the assembly. This coil spring is compressed during the operation and returns the slidable alignment guide to the original position when the operation is completed.

Another preferred embodiment of the invention comprises a screw, bolt, or any combination thereof, to secure and retain the spring stop at the end of the block body holder. The removal of the screw will allow disassembling the assembly if required.

It is an object to provide a design for a device which is highly manufacturable, and in which a majority of the component parts can be economically molded and snap-fit together without the need for assembly tools.

DESCRIPTIONS OF THE DRAWINGS

The following drawings form part of the present specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention, however, one skilled in the art will understand that portions of the example or aspect may be used in combination with other examples or aspects of the invention.

Figure 1:
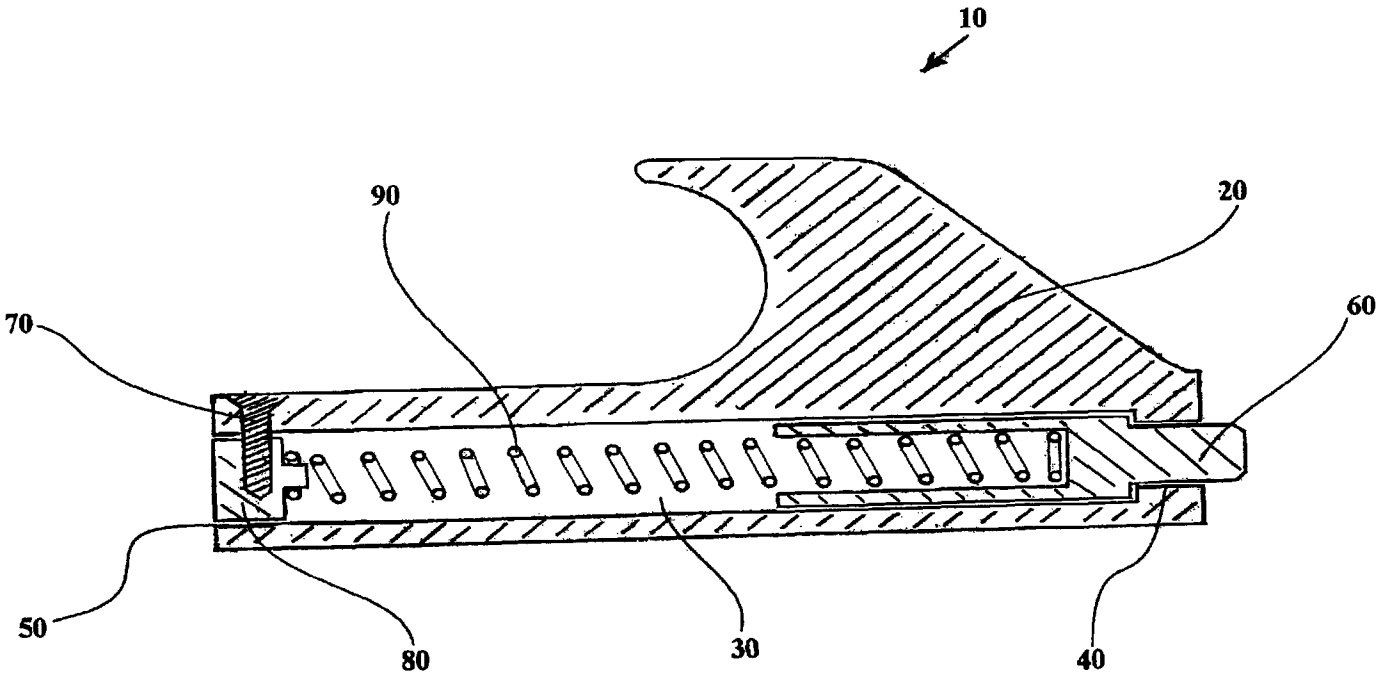
FIG. 1 is a cross sectional view of a handgun loading assistant device according to the invention, showing the slidable alignment guide in its extended position.

As best illustrated in FIG. 1, the pistol loading and/or cocking assistant device 10 comprises a block body holder 20 having longitude channel 30 with openings in both ends, first end 40 and second end 50. The device further comprises a slidable alignment guide 60 that can slide along the channel 30 between retracted position and extended position.

Still in FIG. 1, the device 10 contains a spring stop 80 attachable and detachable from the second end 50 via a screw 70. The spring stop 80 retains a coil spring 90 in between the rear of the device 10 and slidable alignment guide 60.

It is noted that throughout this description, words such as "forward" and "rearward" as well as like terms, refer to portions or elements of the pistol apparatus as they are viewed in the drawings relative to other portions or in relationship to the positions of the apparatus as it will typically be held and moved during play when operated by a user, or to movements of elements based on the configurations illustrated.

Figure 2:
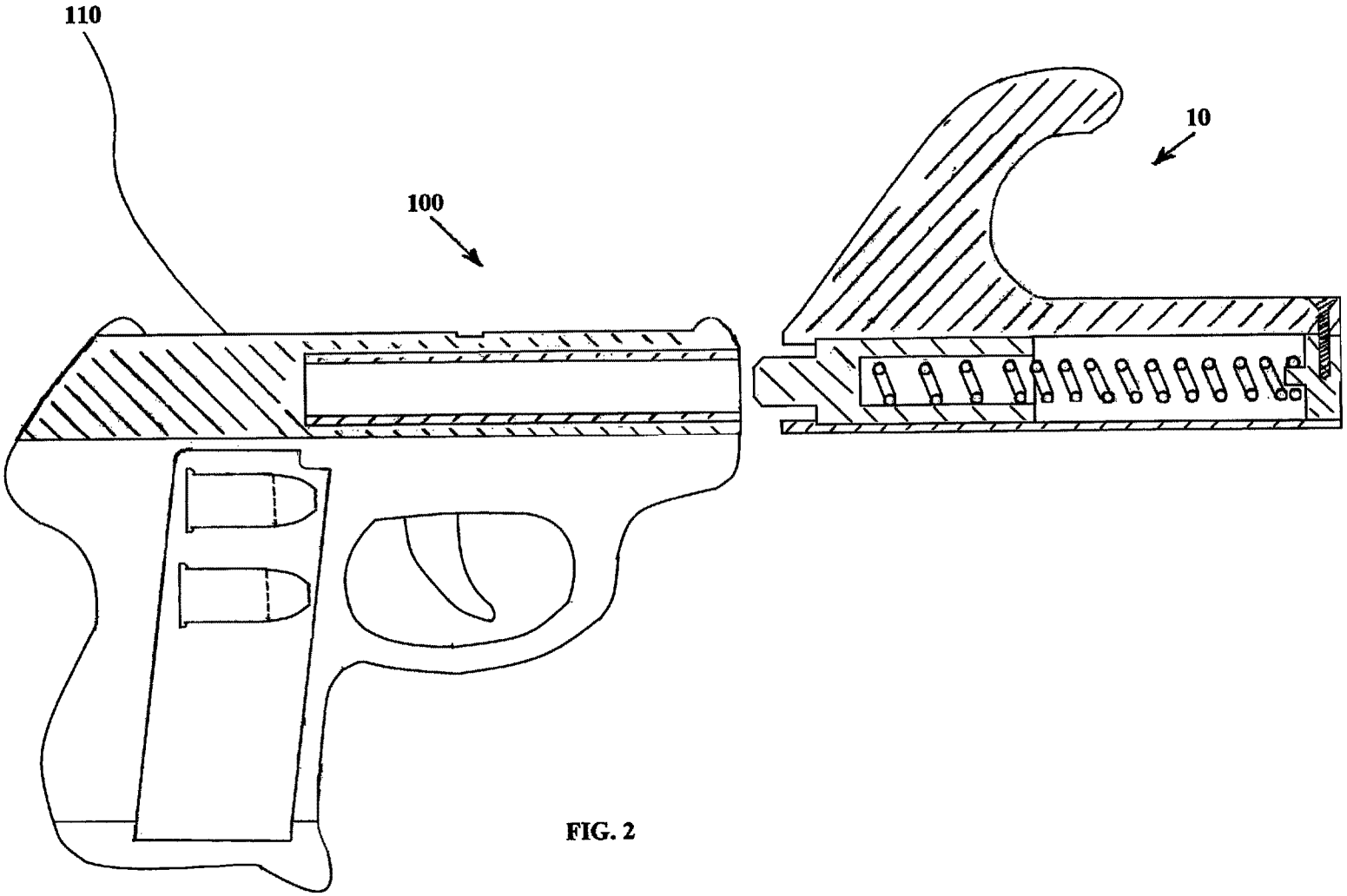
FIG. 2 is a side perspective view of the handgun loading assistant device engaging the pistol. Thus, the handgun may be cocked by the loading system according to the invention.

To explain the device for loading and/or cocking the pistol in accordance with the invention, FIG. 2 illustrates the device 10 engaged with the pistol 100. At this point the block body holder 20 is held back, ready to thrust forward the pistol slide 110. The entire scenario is applicable in the pistol having an opposite longitudinal asymmetry.

Figure 3:
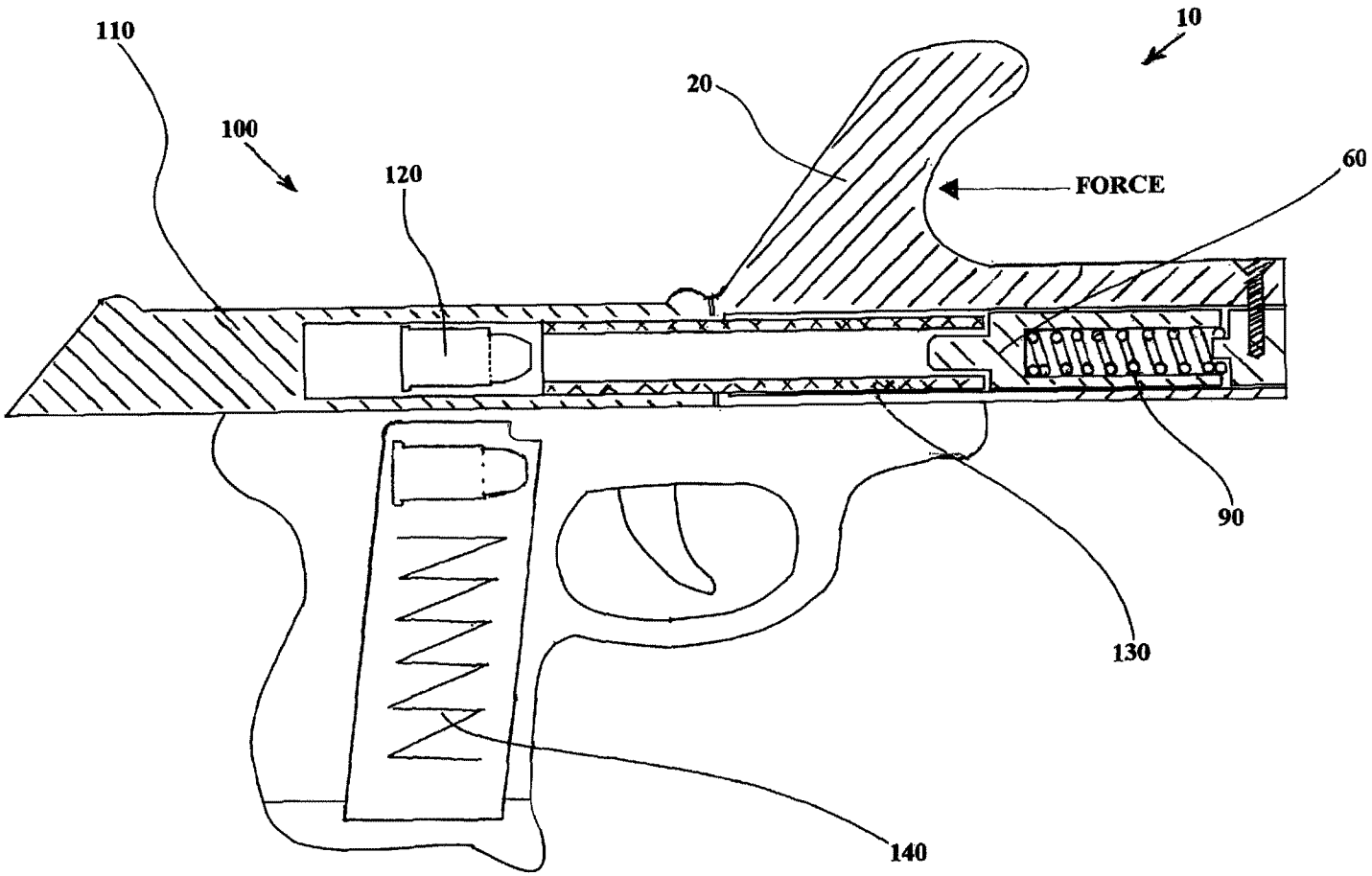
FIG. 3 is a cross sectional view of the handgun loading assistant device, showing the device in an engaged pistol position.

Referring now to FIG. 3, in operation, a user applies force on the block body holder 20 to push forward the device 10 so that the pistol 100 is in opposite direction and the slidable alignment guide 60 is partially inside the pistol barrel 130. The coil spring 90 is then compressed, and the slidable alignment guide 60 is in a retracted position to cause the pistol slide 110 to move rearward allowing the pistol to move into the loader cavity. When the rearward motion of the pistol slide 110 is reached, a cartridge 120 is pushed upward into the chamber by the magazine spring 140 to load the pistol.

Invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

Having illustrated and described the principles of the present invention in a preferred embodiment, it will be apparent to those skilled in the art that the embodiment can be modified in arrangement and detail without departing from such principles. Any and all such embodiments are intended to be included within the scope of the following claims.

What is claimed is:

1. A handgun loading assistant device, comprising:

a block body holder having a longitudinal channel, wherein said channel having a first end and a second end; and an slidable alignment guide slidably arranged in said channel to reciprocally slide between retracted position and extended position, wherein said guide protruding through said first end in said extended position;

wherein a spring stop is securely attached to said block holder by a fastener at said second end channel.

2. The handgun loading assistant device as recited in claim 1, wherein said block body holder further comprises a manipulation means protruding from an outer surface of said block body.

3. The handgun loading assistant device as recited in claim 1 wherein said fastener is selected from a group consisting of a screw, bolt, or any combination thereof.

4. The handgun loading assistant device as recited in claim 1 further comprises a coil spring arranged in said channel to apply pressure on said block body in a forward position forcing a handgun barrel to slide to rearward position for loading said handgun.

* * * * *